US008585373B2

(12) United States Patent
Park

(10) Patent No.: US 8,585,373 B2
(45) Date of Patent: Nov. 19, 2013

(54) HERMETIC COMPRESSOR

(75) Inventor: Bok-Ann Park, Gyeongsangnam-do (KR)

(73) Assignee: LG Electronics Inc., Seoul (KR)

( * ) Notice: Subject to any disclaimer, the term of this patent is extended or adjusted under 35 U.S.C. 154(b) by 164 days.

(21) Appl. No.: 13/145,327

(22) PCT Filed: Dec. 2, 2009

(86) PCT No.: PCT/KR2009/007164

§ 371 (c)(1),
(2), (4) Date: Jul. 19, 2011

(87) PCT Pub. No.: WO2010/085041

PCT Pub. Date: Jul. 29, 2010

(65) Prior Publication Data

US 2011/0280743 A1 Nov. 17, 2011

(30) Foreign Application Priority Data

Jan. 21, 2009 (KR) ..... 10-2009-0005244

(51) Int. Cl.
*F04B 39/00* (2006.01)

(52) U.S. Cl.
USPC ..... 417/312; 417/363; 417/902

(58) Field of Classification Search
USPC ..... 417/312, 363, 902
See application file for complete search history.

(56) References Cited

U.S. PATENT DOCUMENTS 4,793,775 A * 12/1988 Peruzzi ..... 417/312

FOREIGN PATENT DOCUMENTS

| | | | |
|---|---|---|---|
| EP | 0195486 | A2 | 9/1986 |
| WO | WO 86/02703 | | 9/1986 |
| WO | WO 2006/109239 | A1 | 10/2006 |

* cited by examiner

*Primary Examiner* — Charles Freay
*Assistant Examiner* — Patrick Hamo
(74) *Attorney, Agent, or Firm* — McKenna Long & Aldridge LLP

(57) ABSTRACT

The present invention discloses a hermetic compressor which can reduce the noise by regulating a suction pressure in a connector enabling a suction pipe of a hermetic container and a suction muffler to communicate with each other. The hermetic compressor includes: a hermetic container including a suction pipe through which refrigerant is sucked and accommodating a compression mechanism unit for compressing the refrigerant; a suction muffler fixed to the compression mechanism unit and reducing the flow noise when the refrigerant passes; and a connector enabling the suction pipe and the suction muffler to communicate with each other and including a hole on a refrigerant passage to communicate with an inner space of the hermetic container. An inner pressure of the connector is equalized with an inner pressure of the hermetic container, which raises a refrigerant suction pressure. As a difference between the refrigerant suction pressure and the pressure of the compression space is reduced, the noise generated during the refrigerant suction can be reduced.

9 Claims, 5 Drawing Sheets

HERMETIC COMPRESSOR

This application is a National Stage Entry of International Application No. PCT/KR2009/007164, filed on Dec. 2, 2009, and claims the benefit of Korean Patent Application No. 10-2009-0005244, filed Jan. 21, 2009, both of which are hereby incorporated by reference for all purposes as if fully set forth herein in their entireties.

TECHNICAL FIELD

The present invention relates to a hermetic compressor, and more particularly, to a hermetic compressor which can reduce the noise by regulating a suction pressure in a connector enabling a suction pipe of a hermetic container and a suction muffler to communicate with each other.

BACKGROUND ART

In general, a hermetic compressor includes a compression mechanism unit compressing refrigerant by a reciprocating motion, a motor mechanism unit supplying power to the compression mechanism unit, and a hermetic container accommodating the compression mechanism unit and the motor mechanism unit an airtight state. The hermetic compressor, which is a component constituting a freezing system such as a refrigerator, etc., serves to phase-shift low-temperature low-pressure gas refrigerant into high-temperature high-pressure gas refrigerant. Such phase shift can be implemented by a compressive force of a piston linearly reciprocated in a cylinder.

FIG. 1 is a view of an example of a conventional hermetic compressor, and FIG. 2 is a graph of the noise and the refrigerant velocity in the example of the conventional hermetic compressor.

As illustrated in FIG. 1, in the conventional hermetic compressor, a given lower container 1*a* and a given upper container 1*b* are coupled to constitute a hermetic container 1, a motor mechanism unit 4 composed of a stator 2 and a rotor 3 is installed in the hermetic container 1, and a plurality of compression components are installed on the upper side of the motor mechanism unit 4. A plurality of springs S are supported on the lower side of the stator 2 to absorb shock applied to the stator 2 during the rotation of the rotor 3, and components for transferring power are installed between the motor mechanism unit 4 and the compression components.

The components for transferring power include a rotational shaft 5, a cylinder block 6, a sleeve 7 and a connecting rod 8. The rotational shaft 5 is press-fit into a press-fit hole 3*a* penetrating through the center of the rotor 3 in the vertical direction and rotatably inserted into the cylinder block 6. An eccentric portion 5*a* provided at a top end portion of the rotational shaft 5 is coupled to the sleeve 7, and the connecting rod 8 converting a rotational motion into a linear motion is coupled to the sleeve 7.

The compression components include a cylinder 9 and a piston 10. The cylinder 9 is provided at one side of an upper portion of the cylinder block 6, and the piston 10 is inserted into the cylinder 9 and connected to the connecting rod 8 to be linearly reciprocated. Here, a valve device 11 for use in sucking/discharging refrigerant gas into/from a compression space of the cylinder 9 is coupled to an one-side opening portion of the cylinder 9, and a head cover 12 partitioned into a suction space and a discharge space to separate suction refrigerant from discharge refrigerant is coupled to the outside of the valve device 11. In addition, a suction muffler (not shown) is coupled to the lower side of the head cover 12 to communicate therewith. The suction muffler communicates with a suction pipe 14 provided in the hermetic container 1 via a connector (not shown). Moreover, a discharge muffler (not shown) for reducing the noise of discharge refrigerant may be provided on the upper side of the head cover 12 to communicate therewith. The discharge muffler communicates with a discharge pipe 15 provided in the hermetic container 1 via a loop pipe 16.

The operation of the hermetic compressor will be described. When power is applied to the motor mechanism unit 4, the rotor 3 is rotated due to the interaction between the stator 2 and the rotor 3, and the rotational shaft 5 coupled to the rotor 3 is rotated. As the rotation of the rotational shaft 5 is converted into a linear reciprocating motion by the connecting rod 8, the piston 10 is linearly reciprocated in the compression space in the cylinder 9. Here, when the piston 10 moves backward, refrigerant is introduced into the valve device 11 through the suction muffler and the suction space of the head cover 12 via the suction pipe 14. When a suction valve (not shown) of the valve device 11 is open, the refrigerant is sucked into the compression space in the cylinder 9.

Thereafter, when the piston 10 moves forward, the refrigerant compressed in the compression space opens a discharge valve (not shown), is discharged into the discharge space of the head cover 12, and is discharged to the outside through the discharge pipe 15 of the hermetic container 1 via the discharge muffler and the loop pipe 16.

In the conventional hermetic compressor described above, the adhesion of the connector is designed to be higher than an inner pressure of the suction pipe such that the elastic connector is closely attached to the inside of the hermetic container. Therefore, even if the refrigerant varies, the inner pressure of the suction pipe is maintained relatively low. For example, in the case of a hermetic compressor using refrigerant 600*a*, a suction pressure Ps is maintained at −0.43 kgf/cm$^2$, which is a negative pressure (− pressure), and in the case of a hermetic compressor using refrigerant 134*a*, a suction pressure Ps is maintained at 0.14 kgf/cm$^2$, which is a low positive pressure (+pressure).

Accordingly, in the conventional hermetic compressor, since the suction pressure is significantly lower than the pressure of the compression space, as shown in FIG. 2, the refrigerant suction velocity is high (9 m/sec$^2$), but the refrigerant noise in specific frequency bands such as 4 k is high (about 28 dBA). As a result, there is a need to improve noise performance.

DISCLOSURE

Technical Problem

The present invention has been made in an effort to solve the above-described problems of the prior art, and an object of the present invention is to provide a hermetic compressor which can regulate a refrigerant suction pressure to improve noise performance.

Technical Solution

According to an aspect of the present invention for achieving the above object, there is provided a hermetic compressor, including: a hermetic container including a suction pipe through which refrigerant is sucked and accommodating a compression mechanism unit for compressing the refrigerant; a suction muffler fixed to the compression mechanism unit and reducing the flow noise when the refrigerant passes; and a connector enabling the suction pipe and the suction muffler to communicate with each other and including a hole on a refrigerant passage to communicate with an inner space of the hermetic container.

In addition, the number of the hole provided in the connector is set such that a difference between an inner pressure of the connector and an inner pressure of the hermetic container is below a set pressure.

Moreover, the size of the hole provided in the connector is set such that a difference between an inner pressure of the connector and an inner pressure of the hermetic container is below a set pressure.

Further, the location of the hole provided in the connector is set such that a difference between an inner pressure of the connector and an inner pressure of the hermetic container is below a set pressure.

Furthermore, the hole provided in the connector is located adjacent to an inlet of the suction muffler.

Still furthermore, the connector includes a trumpet-shaped corrugated portion and a cylindrical plane portion communicating with the corrugated portion, the hole provided in the connector being provided in the plane portion.

Still furthermore, the corrugated portion of the connector is closely attached to an inside surface of the hermetic container communicating with the suction pipe, and the plane portion of the connector is press-fit into the suction muffler.

Still furthermore, the connector is formed of a rubber material.

Advantageous Effects

In the hermetic compressor according to the present invention, even if the refrigerant is sucked at a low suction pressure through the suction pipe of the hermetic container, the connector and the suction muffler, the suction pressure of the connector is equalized with the inner pressure of the hermetic container through the hole provided in the connector. Thus, the refrigerant suction pressure is raised and the refrigerant velocity is lowered. There is an advantage in that noise performance in specific frequency bands can be improved.

BEST MODE FOR CARRYING OUT INVENTION

Hereinafter, exemplary embodiments of the present invention will be described in detail with reference to the accompanying drawings.

Figure 1:
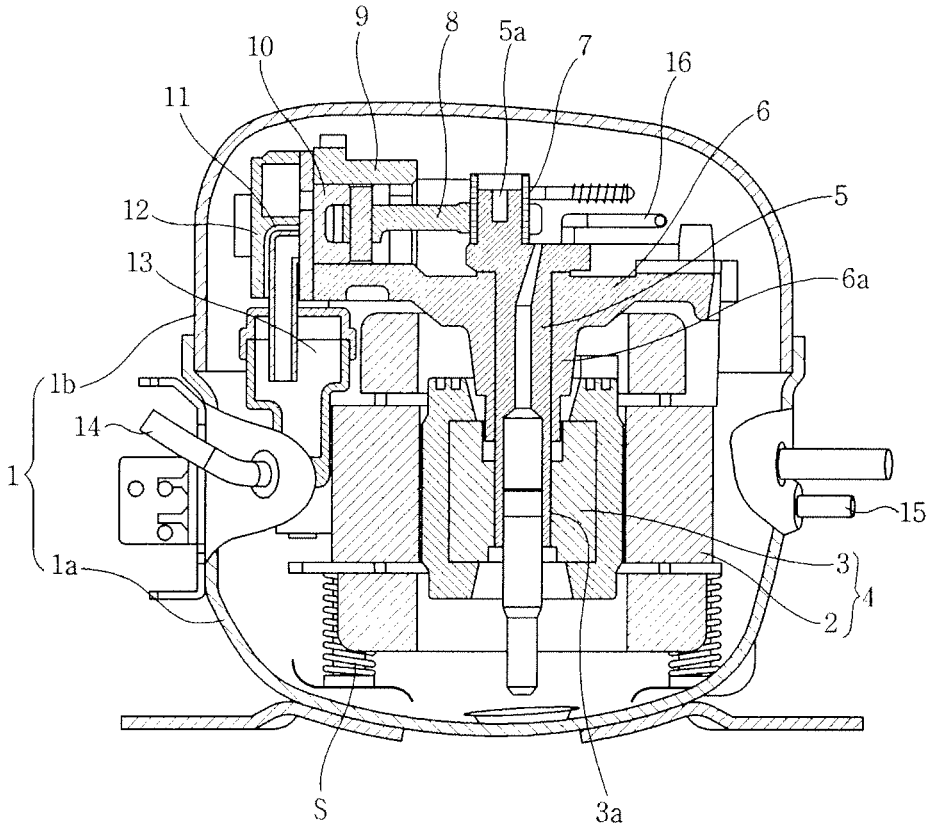
FIG. 1 is a view of an example of a conventional hermetic compressor.
Figure 2:
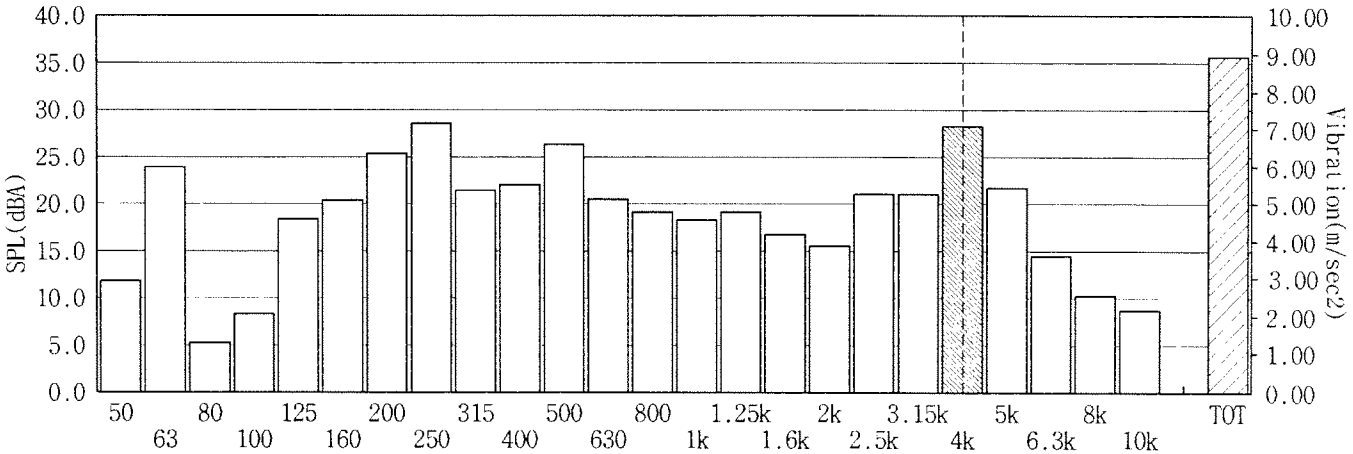
FIG. 2 is a graph of the noise and the refrigerant velocity in the example of the conventional hermetic compressor.
Figure 3:
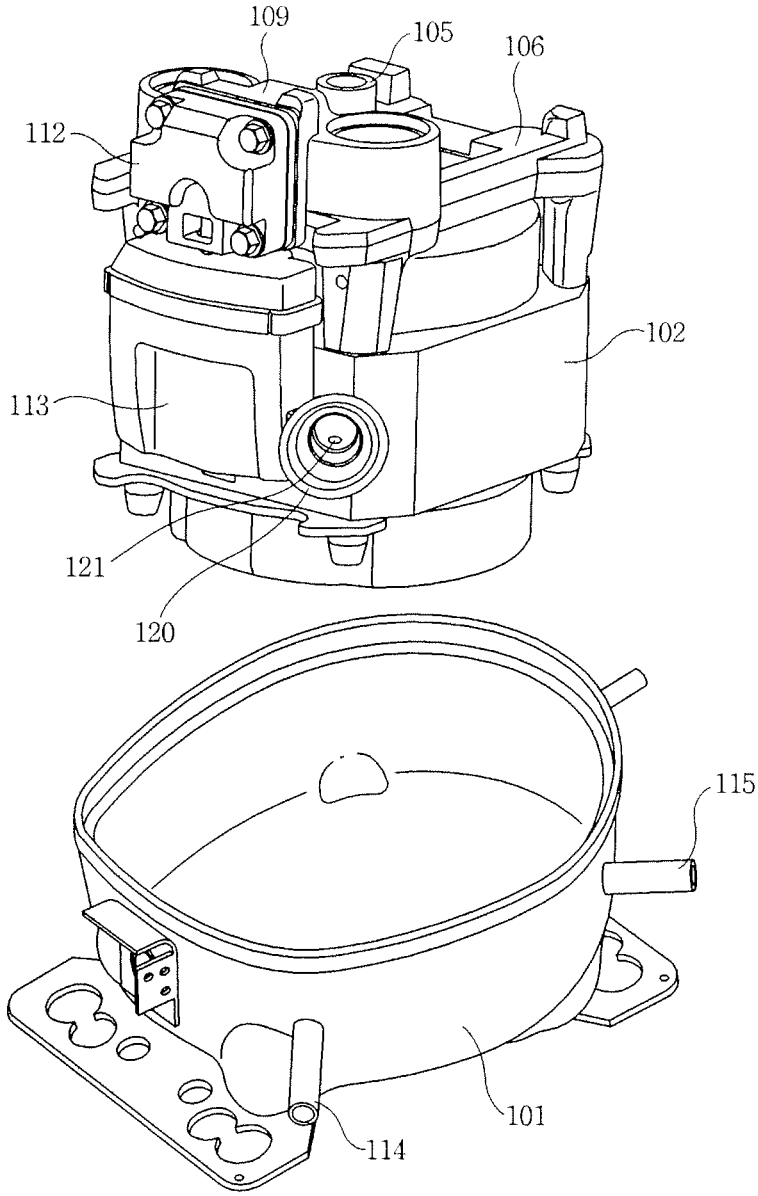
FIG. 3 is a view of an embodiment of a hermetic compressor according to the present invention.
Figure 4:
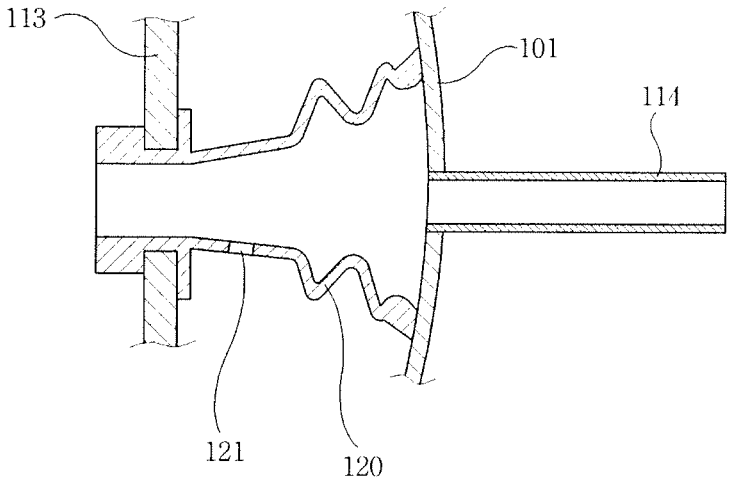
FIG. 4 is a view of a refrigerant suction noise reduction structure in the embodiment of the hermetic compressor according to the present invention.

FIG. 3 is a view of an embodiment of a hermetic compressor according to the present invention, and FIG. 4 is a view of a refrigerant suction noise reduction structure in the embodiment of the hermetic compressor according to the present invention.

As illustrated in FIGS. 3 and 4, in the embodiment of the hermetic compressor according to the present invention, a given lower container 101 and a given upper container (not shown) are coupled to constitute a hermetic container (hereinafter, indicated by reference numeral 101 of the lower container), and an assembly of a stator 102, a rotor (not shown), a rotational shaft 105, a cylinder block 106, a cylinder 109, a piston (not shown), a valve device (not shown), a head cover 112 and a suction muffler 113 is installed in the hermetic container 101. The respective components have been publicly known, and thus their detailed description will be omitted. A suction pipe 114 guiding refrigerant to be sucked into the hermetic container 101 and a discharge pipe 115 guiding refrigerant to be discharged to the outside of the hermetic container 101 are provided. The suction muffler 113 and the suction pipe 114 communicate with each other via a connector 120 formed of a given elastic material.

The suction muffler 113 includes two covers coupled to each other to define an inner noise space, and a bent pipe accommodated therein. The suction muffler 113 not only reduces the noise of suction refrigerant but also prevents heating of the suction refrigerant when it is sucked into the cylinder 109 through the head cover 112.

The connector 120 is formed of a given rubber material with elasticity. One end of the connector 120 is a cylindrical plane portion and the other end thereof is a trumpet-shaped corrugated portion. Here, the plane portion of the connector 120 is coupled between the covers of the suction muffler 113 to be engaged therewith and installed to communicate with the bent pipe of the suction muffler 113. The corrugated portion of the connector 120 is brought into contact with the inside of the hermetic container 101 to communicate with the suction pipe 114. The connector 120 may be bent at a given angle according to the location of an inlet of the suction muffler 113 and the suction pipe 114.

A hole 121, which enables an inner space of the connector 120 and an inner space of the hermetic container 101 to communicate with each other, is provided in the connector 120. An inner pressure of the connector 120 may be equalized with an inner pressure of the hermetic container 101 through the hole 121. Accordingly, in order to equalize the inner pressure of the connector 120 with the inner pressure of the hermetic container 101 within a preset pressure according to the operation conditions, the number and size of the hole 121 and the location of the hole 121 in the connector 120 may be determined in various ways. For example, preferably, one or more holes 121 are provided in the plane portion of the connector 120 connected to the inlet of the suction muffler 113 so as to be adjacent to the inlet of the suction muffler 113. The hole 121 may be provided in the corrugated portion of the connector 120. However, if the hole 121 is positioned in the corrugated portion of the connector 120, since the refrigerant suction pressure is maintained relatively low, the corrugated portion of the connector 120 is closely attached to the inside surface of the hermetic container 101 and folded. This may interrupt fast equalization between the inner pressure of the connector 120 and the inner pressure of the hermetic container 101. Moreover, the inner pressure of the corrugated portion-side of the connector 120 is equalized with the inner pressure of the hermetic container 101, which reduces the adhesion of the corrugated portion of the connector 120 to the inside of the hermetic container 101. This leads to a refrigerant flow loss.

The operation of the hermetic compressor according to the present invention will be described.

When power is applied to a motor mechanism unit (not shown), the rotor (not shown) is rotated due to the interaction between the stator 102 and the rotor. As the rotation force of the rotor is converted into a linear reciprocating motion of the piston (not shown), the piston is linearly reciprocated in a compression space in the cylinder 109. Here, when the piston moves backward, refrigerant is introduced into the valve device (not shown) through the suction pipe 114, the connector 120, the suction muffler 113 and a suction space of the head cover 112. When a suction valve (not shown) of the valve device is open, the refrigerant is sucked into the compression space in the cylinder 109. Thereafter, when the piston moves forward, the refrigerant compressed in the compression space opens a discharge valve (not shown), is discharged into a discharge space of the head cover 112, and is discharged to the outside through the discharge pipe 115 of the hermetic container 101 via a discharge muffler (not shown) and a loop pipe (not shown).

When the hermetic compressor is operated as described above, heat is generated due to the operation of the motor mechanism unit and the motion of the piston. While the inner pressure of the hermetic container 101 is maintained relatively high, the pressure of the refrigerant sucked through the suction pipe 114, the connector 120 and the suction muffler 113 is maintained lower than the inner pressure of the hermetic container 101. However, the pressures are equalized through the hole 121 of the connector 120. That is, the inner pressure of the hermetic container 101 is lowered and the inner pressure of the connector 120 is raised. Therefore, even if the suction pressure is maintained low according to the operation conditions, it can be equalized with the inner pressure of the hermetic container 101. As the suction pressure rises, the refrigerant suction velocity proportional to a difference between the pressure of the compression space and the suction pressure is reduced. However, the refrigerant suction noise of specific frequency bands can be reduced.

Figure 5:
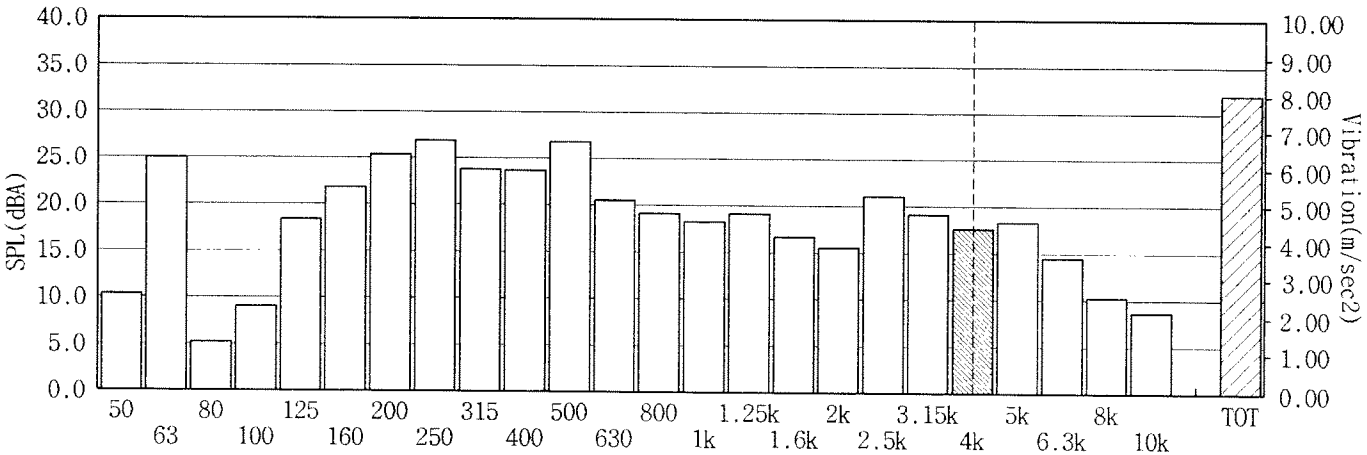
FIG. 5 is a graph of the noise and the refrigerant velocity in the embodiment of the hermetic compressor according to the present invention.

FIG. 5 is a graph of the noise and the refrigerant velocity in the embodiment of the hermetic compressor according to the present invention. In the hermetic compressor operated as described above, even if the suction pressure is maintained low according to the operation conditions, it is equalized with the inner pressure of the hermetic container. As illustrated in FIG. 5, the refrigerant suction velocity is 8 $m/sec^2$, which is slightly lower than 9 $m/sec^2$ of the conventional hermetic compressor, but the refrigerant noise in specific frequency bands such as 4 k is about 18 dBA, which is much lower than about 28 dBA of the conventional hermetic compressor. It is apparent that noise performance is improved.

The present invention has been described in connection with the exemplary embodiments and the accompanying drawings. However, the scope of the present invention is not limited thereto but is defined by the appended claims.

The invention claimed is:

1. A hermetic compressor, comprising:

a hermetic container including a suction pipe through which refrigerant is sucked and accommodating a compression mechanism unit for compressing the refrigerant;

a suction muffler fixed to the compression mechanism unit and reducing the flow noise when the refrigerant passes; and a connector enabling the suction pipe and the suction muffler to communicate with each other and including one or more holes on a refrigerant passage to communicate with an inner space of the hermetic container, wherein the connector comprises a trumpet-shaped corrugated portion contacted with the inside surface of the hermetic container and a cylindrical plane portion extended from the corrugated portion to communicate with the suction muffler, the hole provided in the connector being provided in the cylindrical plane portion.

2. The hermetic compressor of claim 1, wherein a number of holes provided in the connector is set such that a difference between an inner pressure of the connector and an inner pressure of the hermetic container is below a set pressure.

3. The hermetic compressor of claim 1, wherein the size of the hole provided in the connector is set such that a difference between an inner pressure of the connector and an inner pressure of the hermetic container is below a set pressure.

4. The hermetic compressor of claim 1, wherein the corrugated portion of the connector is closely attached to an inside surface of the hermetic container communicating with the suction pipe, and the plane portion of the connector is press-fit into the suction muffler.

5. The hermetic compressor of claim 2, wherein the corrugated portion of the connector is closely attached to an inside surface of the hermetic container communicating with the suction pipe, and the plane portion of the connector is press-fit into the suction muffler.

6. The hermetic compressor of claim 3, wherein the corrugated portion of the connector is closely attached to an inside surface of the hermetic container communicating with the suction pipe, and the plane portion of the connector is press-fit into the suction muffler.

7. The hermetic compressor of claim 1, wherein the connector is formed of a rubber material.

8. The hermetic compressor of claim 2, wherein the connector is formed of a rubber material.

9. The hermetic compressor of claim 3, wherein the connector is formed of a rubber material.

* * * * *